US012305634B2

(12) United States Patent
Herden et al.

(10) Patent No.: US 12,305,634 B2
(45) Date of Patent: May 20, 2025

(54) COMPRESSOR SYSTEM AND METHOD FOR OPERATING A COMPRESSOR SYSTEM AS A FUNCTION OF THE COMPRESSED-AIR DEMAND OF AN OPERATING STATE OF A VEHICLE

(71) Applicant: KNORR-BREMSE Systeme für Schienenfahrzeuge GmbH, Munich (DE)

(72) Inventors: Marc-Oliver Herden, Munich (DE); Michael Winkler, Munich (DE); Martin Schmid, Munich (DE)

(73) Assignee: KNORR-BREMSE SYSTEME FÜR SCHIENENFAHRZEUGE GMBH (DE)

( * ) Notice: Subject to any disclaimer, the term of this patent is extended or adjusted under 35 U.S.C. 154(b) by 186 days.

(21) Appl. No.: 17/758,628

(22) PCT Filed: Dec. 29, 2020

(86) PCT No.: PCT/EP2020/087998
§ 371 (c)(1),
(2) Date: Jul. 11, 2022

(87) PCT Pub. No.: WO2021/140049
PCT Pub. Date: Jul. 15, 2021

(65) Prior Publication Data

US 2023/0045392 A1 Feb. 9, 2023

(30) Foreign Application Priority Data

Jan. 9, 2020 (DE) ..... 10 2020 100 296.3

(51) Int. Cl.
*F04B 49/08* (2006.01)
*F04B 41/02* (2006.01)
(Continued)

(52) U.S. Cl.
CPC ..... *F04B 49/08* (2013.01); *F04B 41/02* (2013.01); *F04B 49/06* (2013.01); *F04B 49/103* (2013.01); *F04B 49/20* (2013.01)

(58) Field of Classification Search
CPC ..... F04B 49/08; F04B 49/20; F04B 41/02; F04B 49/06; F04B 49/065; F04B 49/103; F04B 2203/0208; F04B 2203/0209
See application file for complete search history.

(56) References Cited

U.S. PATENT DOCUMENTS 2,704,631 A 3/1955 Bancel
3,177,921 A 4/1965 George
(Continued)

FOREIGN PATENT DOCUMENTS

AT 518199 A1 8/2017
CN 105934583 A 9/2016
(Continued)

OTHER PUBLICATIONS

International Search Report and Written Opinion corresponding to PCT/EP2020/087998 dated Feb. 17, 2021.
(Continued)

*Primary Examiner* — Philip E Stimpert
(74) *Attorney, Agent, or Firm* — Barnes & Thornburg LLP

(57) ABSTRACT

A compressor system and method for operating a compressor system according to the compressed-air demand in an operating state of the vehicle utilize a compressor for producing compressed air for at least one compressed-air vessel, the delivery rate of the compressor being able to be adjusted at least indirectly by means of a control device. The control device is configured to be able to increase the delivery rate of the compressor beyond a defined operating maximum rate when there is exceptional demand.

18 Claims, 1 Drawing Sheet

(51) Int. Cl.

| | |
|---|---|
| ***F04B 49/06*** | (2006.01) |
| ***F04B 49/10*** | (2006.01) |
| ***F04B 49/20*** | (2006.01) |

(56) References Cited

U.S. PATENT DOCUMENTS

| | | | | |
|---|---|---|---|---|
| 4,756,669 | A | 7/1988 | Hata | |
| 6,461,112 | B1 | 10/2002 | Ohta et al. | |
| 2004/0237553 | A1 | 12/2004 | Yamasaki et al. | |
| 2004/0265134 | A1 | 12/2004 | Limura et al. | |
| 2016/0290562 | A1* | 10/2016 | Okuno | F04B 35/04 |
| 2016/0311420 | A1* | 10/2016 | Assmann | F04D 25/06 |
| 2016/0341460 | A1 | 11/2016 | Pham et al. | |
| 2018/0223832 | A1 | 8/2018 | Ren et al. | |
| 2019/0010939 | A1 | 1/2019 | Karp et al. | |

FOREIGN PATENT DOCUMENTS

| | | | |
|---|---|---|---|
| DE | 1193732 | B | 5/1965 |
| DE | 2727449 | A1 | 3/1978 |
| DE | 602004009634 | T2 | 2/2008 |
| DE | 102012223996 | A1 | 6/2014 |
| DE | 102013113555 | A1 | 6/2015 |
| DE | 102013113556 | A1 | 6/2015 |
| DE | 102013113557 | A1 | 6/2015 |
| DE | 102014213653 | A1 | 1/2016 |
| DE | 102017001914 | A1 | 8/2018 |
| DE | 102017010772 | A1 | 5/2019 |
| DE | 102013003512 | B4 | 12/2020 |
| EP | 2964955 | B1 | 3/2019 |
| JP | 2000062389 | A | 2/2000 |
| JP | 2016217288 | A | 12/2016 |
| JP | 2016540925 | A | 12/2016 |
| JP | 2019167911 | A | 10/2019 |
| KR | 20160093668 | A | 8/2016 |

OTHER PUBLICATIONS

Korean Office Action corresponding to KR 10-2022-7024762 dated Mar. 3, 2024.

Japanese Office Action corresponding to JP 2022-542228 dated Mar. 8, 2024.

Singh, Jagdev et al.—Fuzzy Modeling and Identification of Intelligent Control for Refridgeration Compressor; Journal of Scientific & Industrial Research vol. 65, Jan. 2006, pp. 22-30.

* cited by examiner

COMPRESSOR SYSTEM AND METHOD FOR OPERATING A COMPRESSOR SYSTEM AS A FUNCTION OF THE COMPRESSED-AIR DEMAND OF AN OPERATING STATE OF A VEHICLE

CROSS REFERENCE AND PRIORITY CLAIM

This patent application is a U.S. National Phase of International Patent Application No. PCT/EP2020/087998 filed Dec. 29, 2020, which claims priority to German Patent Application No. 10 2020 100 296.3, the disclosure of which being incorporated herein by reference in their entireties.

FIELD

Disclosed embodiments relate to a compressor system and to a method for operating a compressor system as a function of the compressed-air demand of an operating state of a vehicle

BACKGROUND

Diverse, sometimes contrary, requirements are imposed on compressors in rail vehicles, such as, for instance, a high delivery capacity, sufficient on-periods, low acoustic emissions, a low consumption of energy, a small installation space, flexible operating strategies and also low procurement costs and life-cycle costs. In this connection, there are greatly differing requirement profiles with respect to the compressor, depending upon the operating state of the rail vehicle. The typical problem encountered when designing a compressor consists in finding the best compromise between these requirements that is acceptable in all operating states of the rail vehicle. As a rule, compressors that are driven electrically are employed in rail vehicles. The compressors are operated in on/off mode between a lower switch-on pressure and an upper switch-off pressure at a constant speed, the so-called rated speed, or at a variable speed. The compressor is dimensioned in such a way that a predetermined time for topping up the compressed-air vessel is reached and a minimal on-period is not fallen short of during operation.

The physical size and, hence, the maximum output of the compressor have, as a rule, been chosen in such a way that in the line mode—that is to say, in the course of regular running of the vehicle—a minimal on-period is not fallen short of and the maximum time for topping up the compressed-air vessel is not exceeded. In addition, further factors—such as, for instance, the efficiency and the power consumption at rated speed or the acoustic emission at various speeds—play a role in the dimensioning of the compressor. In the line mode, the compressor is operated intermittently. The compressor is started when the pressure in the compressed-air vessel has fallen to the switch-on pressure. When the switch-off pressure is reached, the compressor is switched off and is restarted only after a fall in pressure to the switch-on pressure. During a station mode, in the course of which the rail vehicle is stopping at a station, the compressor is operated intermittently in the same way as during running. Since at a standstill no dominant running noise is present, acoustic emissions of the compressor and of the fan on the platform should be avoided. Since the air suspension displays an increased demand for air in a station, on account of the passengers getting on and off, this frequently results in the compressor and the fan being switched on if the compressed-air reservoir is not filled completely when approaching the halt, and hence in undesirable acoustic emissions during the stop at the station.

In order to ensure an economical and ecological operation of the compressor, the intermittent operation described above has been developed further to the effect that the compressor is operated in such a manner that the air pressure in the compressed-air vessel during the running of the vehicle varies within a range just above the switch-on pressure. The conveying capacity of the compressor is increased only when compressed air is consumed. In this way, losses of air pressure by reason of leakage can be minimized, and an unnecessary energizing of the compressor and an associated consumption of energy can be prevented.

However, such a strategy involves the risk that too little compressed air is available in the event of an unforeseen, suddenly sharply rising consumption of compressed air, and consequently an undersupply may occur. The undersupply may result in the triggering of a traction lock until such time as the compressed-air vessel has been refilled, as a result of which delays in the traffic schedule may occur.

SUMMARY

It is, therefore, an object of the disclosed embodiments to make available a compressor system and a method for operating a compressor system, by virtue of which the risk of an undersupply can be minimized and an unusually high demand for compressed air can be reacted to at short notice without permanently increasing the air pressure in the compressed-air vessel.

Thus, disclosed embodiments relate to a compressor system and to a method for operating a compressor system as a function of the compressed-air demand of an operating state of a vehicle. The method relates, in particular, to the operation of a compressor system in an operating state in which such a high demand for compressed air prevails that there is the risk of an undersupply of the compressed-air system. Such a high demand may be designated in the following as a "borderline high compressed-air demand."

BRIEF DESCRIPTION OF THE FIGURES

Disclosed embodiments will be described in more detail in the following with reference to the appended drawings. The drawings show.

DETAILED DESCRIPTION

Figure 1:
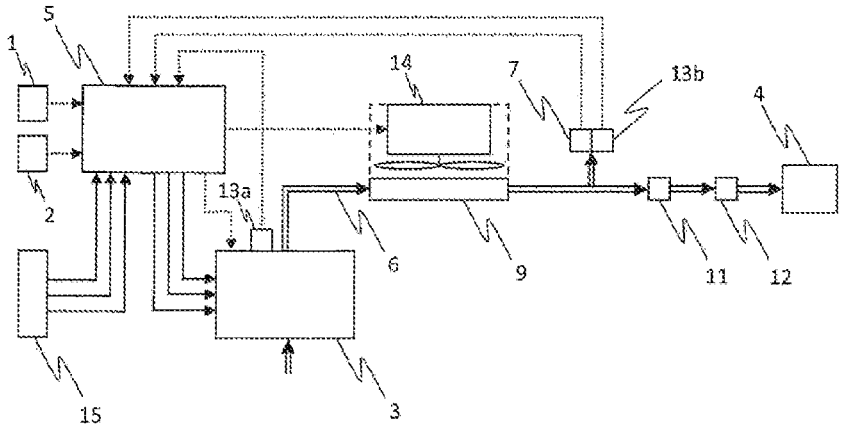
FIG. 1 a schematic arrangement of a compressor system according to the disclosed embodiments.

In accordance with disclosed embodiments, a compressor system for a rail vehicle exhibits at least one compressor for generating compressed air for at least one compressed-air vessel, the conveying capacity of the at least one compressor being adjustable, at least indirectly, via at least one feedback-control device. Furthermore, at least one pressure sensor is optionally arranged in a line carrying compressed air, arranged downstream of the at least one compressor, the at least one feedback-control device regulating the at least one compressor on the basis of the pressure measured therewith. The at least one feedback-control device of the at least one compressor has furthermore been configured in such a manner that in a special case of need it can increase the conveying capacity of the at least one compressor beyond a specified maximum operating power, even if this means exceeding the limiting values with respect to noise or power consumption that have been specified in normal operation. This increase in the conveying capacity may happen only for a short time, in order not to endanger safe operation.

In the context of this application, the "maximum operating power" is understood to mean the power at which the at least one compressor is operated maximally in normal operation (that is to say, not in a special case of need). This does not necessarily have to constitute the maximum power or the rated power (maximally achievable power in continuous operation) of the at least one compressor. It is conceivable, for instance, that merely 80% of the rated power of the compressor is specified as the maximum operating power of the compressor, in order to operate the at least one compressor in a manner that is particularly favorable in terms of consumption and optimized as regards wear.

By virtue of the increase beyond the maximum operating power of the compressor, in the case of need a conveying capacity can be made available that permits the increased compressed-air requirements in this case to be met, so that an undersupply of the system can be prevented or the compressed-air vessel can be filled completely when approaching a halt, even though there is an increased consumption of compressed air. Consequently, the compressor can be prevented from starting up during the stay in the station or during a standstill, and consequently the noise pollution can be reduced.

In accordance with at least one embodiment, at least one pressure sensor is arranged in a line carrying compressed air, arranged downstream of the at least one compressor, on the basis of which the air pressure or the air-pressure gradient is determined. By virtue of the determination of the air pressure or of the gradient thereof, a special case of need can be identified particularly easily and effectively.

In accordance with at least one embodiment, the special case of need obtains when there is a borderline high consumption of compressed air. Consequently, in a case in which the consumption of compressed air exceeds a particular limiting value, the conveying capacity of the at least one compressor is increased beyond the specified maximum operating power.

In accordance with at least one embodiment, the at least one feedback-control device has been configured to adjust the conveying capacity of the at least one compressor, in particular via the speed of the compressor.

Of particular utility, furthermore, is an embodiment in which the compressor system exhibits at least one sensor that has been configured to record a measured value that is suitable to monitor the compressor system in the case where the conveying capacity of the at least one compressor lies above the specified maximum operating power of the compressor. In this way, it can be ensured that the at least one compressor does not get damaged at increased conveying capacity, in order to prevent superfluous and cost-intensive maintenance work.

In accordance with at least one embodiment, the compressor system exhibits a man/machine interface. This interface is arranged in the vehicle-driver's cockpit and can be operated by the driver. If this is the case, the special case of need is communicated directly to the at least one feedback-control device so that the feedback-control device increases the conveying capacity of the at least one compressor beyond the specified maximum operating power.

In accordance with at least one embodiment, the at least one feedback-control device has been configured to suppress the energizing of the compressor system in a further special case of need, taking specified operating parameters into consideration. Such operating parameters may be, for instance, the position of the vehicle in connection with the current time and the current date, or the pressure in the compressed-air vessel.

A method according to at least one embodiment controls a compressor system, in the special case of need—in particular, in the case of a borderline high consumption of compressed air—the at least one compressor is operated at a speed that is greater than a certain speed that results in a specified maximum operating power of the compressor.

In accordance with at least one disclosed embodiment, the special case of need is reported by the driver of the vehicle and/or by the vehicle control system to the at least one feedback-control device. This embodiment is particularly useful when the case of need is reported by the vehicle control system only when it is confirmed by the train driver, since consequently it can be ensured in the best possible way that the excessive conveying capacity can also really be deemed necessary. In the case of a vehicle operating autonomously, the vehicle control system alone can pass on the case of need to the feedback-control device.

According to FIG. 1, a compressor system for a rail vehicle exhibits a compressor 3 for generating compressed air. The compressed air generated by the compressor 3 is routed via a line 6 carrying compressed air to a cooling unit 9 with a cooling fan 14. A pressure sensor 7 and a temperature sensor 13*b* are arranged downstream of the cooling unit 9 in the line 6 carrying compressed air. Moreover, the line 6 carrying compressed air leads into a pre-separator 11 to which an air-treatment plant 12 is connected downstream. The dried compressed air, cleansed of particles, is then fed into a compressed-air vessel 4. A temperature sensor 13*a*, which is arranged on the compressor 3, and also temperature sensor 13*b* and the pressure sensor 7 all send the measured temperatures and the measured pressure to a feedback-control device 5. Furthermore, the feedback-control device 5 also receives signals from a vehicle control system 2 and from the vehicle driver 1. In addition, the feedback-control device 5 is suitable to regulate both the speed of the cooling unit 9 and the compressor 3 itself. Furthermore, an electrical supply 15 is provided which supplies the compressor 3 with power via the feedback-control unit 3. Depending upon the demanded compressor speed, the feedback-control device is consequently able to regulate the power supply of the compressor, ordinarily by a frequency converter.

Figure 2:
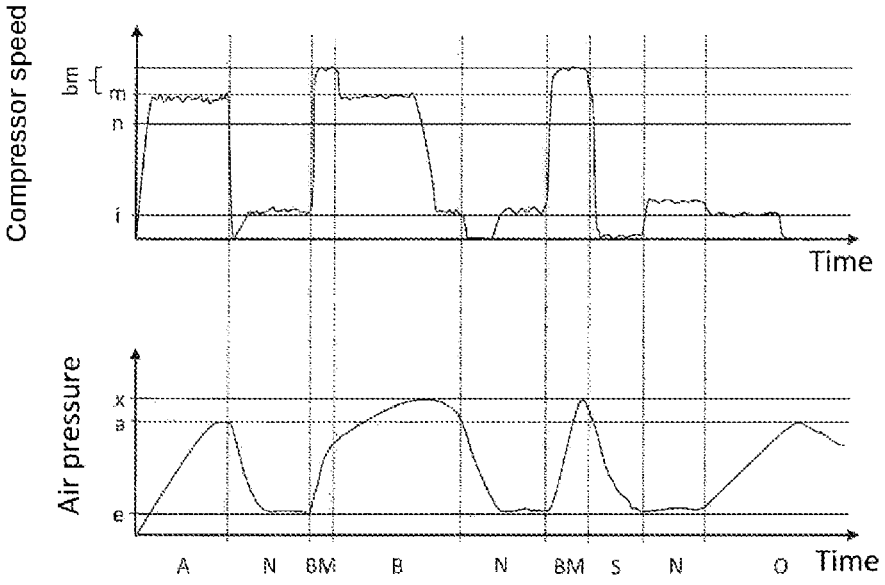
FIG. 2 includes two diagrams which represent, on the one hand, the speed of the compressor and, on the other hand, the air pressure in the compressed-air vessel over time.

According to FIG. 2, it becomes evident that the air pressure in the compressed-air vessel 4 is adjustable via the speed of the compressor 3. The upper diagram illustrates the progression of the speed over time, whereas the lower diagram represents the progression of the air pressure in the compressed-air vessel 4 over time.

In a topping-up mode A of the rail vehicle, the compressor 3 is operated at a speed m required for a maximum operating power of the compressor until the air pressure in the compressed-air vessel 4 reaches the switch-off pressure a. In a subsequent line mode N, in which the rail vehicle in standard operation is running on a line, the compressor 3 is firstly switched off as soon as the compressed-air vessel has been filled. After a considerable part of the compressed air has been consumed during the journey, the compressor is subsequently operated at a variable speed, slightly above the minimum speed i. The air pressure in the compressed-air vessel 4 is kept within a range that is set slightly above the switch-on pressure e. In this way, it can be ensured that only so much compressed air is generated as is also actually consumed, and that economical operation can consequently be ensured, since the loss of pressure at high pressure by reason of leakage is higher than at lower pressure. In addition, the energy losses are likewise lower at a lower pressure level.

If the air pressure varies within a range just above the switch-on pressure e, as indicated in the first line mode N of the lower diagram from FIG. 2, a briefly high demand for compressed air may result in an undersupply of the compressed-air system. If this case arises, a boost mode BM is activated, in order to fill the pressure accumulator as quickly as possible. In this case, the speed is briefly operated above the speed m specified, for instance, by reason of acoustic emissions or power consumption of the compressor, which results in the maximum operating power of the compressor, within a boost-mode speed range bm, in order to avoid an undersupply of compressed air. The boost mode BM can be triggered by the vehicle driver or automatically by the train control system. A briefly high demand for compressed air may become necessary, for instance, by reason of a necessary abrupt braking in the case of a high load of the train.

Once the compressed-air level of the system has been stabilized again, after the boost mode BM in FIG. 2 the normal braking mode B is continued. The compressor 3 continues to be operated at the maximum speed m, and the compressed-air vessel 4 is fed as far as a maximum overpressure x, the compressor 3 being operated at a variable speed, between the rated speed n and the minimum speed i, slightly above the minimum speed i, after reaching the maximum overpressure x. After the braking mode B is concluded, the compressor 3 is switched off and is set to the minimum speed i only when the switch-on pressure e is reached. The rail vehicle is consequently back in the line mode N.

Prior to a station mode S, the feedback-control device 5 receives a signal from the vehicle control system 10 concerning the imminent station mode S, the speed of the compressor 3 normally being set to the maximum speed m, in order to feed the at least one compressed-air vessel 4 as far as the maximum overpressure x. If the time until the train comes to a standstill is not sufficient to raise the air pressure in the compressed-air vessel 4 to the maximum air pressure x, or if an unexpectedly high demand for air pressure arises during the braking procedure, the boost mode BM is likewise activated, and the speed of the compressor is raised above the specified maximum speed m, in order to fill the compressed-air vessel 4 completely. During the station mode S, the compressor 3 is switched off, as far as possible over the entire stay at the halt, in order to cause noise emissions at the halt that are as low as possible. For this reason, it is important, particularly in the case of high consumption of compressed air while stationary—for instance, by virtue of great alternations of load of the vehicle due to passengers getting on and off—that the compressed-air vessel has been filled to the maximum when approaching the halt. When the switch-on pressure e is reached, the compressor 3 is set to the minimum speed i. After the station mode S, the rail vehicle is back in the line mode N. In an overnight-standby mode O, the compressor 3 is operated intermittently between the minimum speed i, when the pressure drops to the switch-on pressure e, and the disconnection of the compressor 3 when the switch-off pressure a is reached.

The disclosed embodiments are not restricted to the illustrated embodiment examples described above. Rather, modifications thereof that are covered by the scope of protection of the following claims are also conceivable. For instance, it is also possible that the compressor 3 feeds a plurality of compressed-air vessels 4. In addition, it is also conceivable that the actuating element 8 is provided with two outputs and consequently sets both the speed of the electric machine 1 and the speed of the cooling fan 14 by the feedback-control device 5.

LIST OF REFERENCE SYMBOLS

1 vehicle driver
2 vehicle control system
3 compressor
4 pressure vessel
5 feedback-control device
6 line carrying compressed air
7 pressure sensor
9 cooling unit
11 pre-separator
12 compressed-air treatment plant
13*a* temperature sensor (compressor)
13*b* temperature sensor (compressed air)
14 cooling fan
15 electrical supply
m speed of the compressor at maximum operating power
n rated speed of the compressor
i minimum speed of the compressor
bm boost-mode speed range
x maximum air pressure in the compressed-air vessel
a switch-off pressure
e switch-on pressure
A topping-up mode
N line mode
B braking mode
S station mode
O overnight mode
BM boost mode

The invention claimed is:

1. A compressor system for a rail vehicle, the compressor system comprising:

at least one compressor for generating compressed air for at least one compressed-air vessel; and at least one feedback-control device, wherein conveying capacity of the at least one compressor is adjustable, at least indirectly, via the at least one feedback-control device, wherein the at least one feedback-control device is configured to increase the conveying capacity of the compressor beyond a specified maximum operating power during a braking operation to a boosted power in a special case of need until a compressed-air level in the at least one compressed-air vessel is stabilized, and wherein, subsequent to the compressed-air level stabilization the feedback-control is configured to resume the specified maximum operating power during the braking operation.

2. The compressor system of claim 1, further comprising at least one pressure sensor arranged in a line carrying the compressed air, arranged downstream of the at least one compressor, for determining the air pressure and/or the air-pressure gradient.

3. The compressor system of claim 1, wherein the at least one feedback-control device is configured to increase the conveying capacity of the at least one compressor beyond the specified maximum operating power in the special case of need of a borderline high consumption of compressed air.

4. The compressor system of claim 1, wherein the at least one feedback-control device is configured to adjust the conveying capacity of the at least one compressor via the speed of the at least one compressor.

5. The compressor system of claim 1, further comprising at least one sensor configured to measure a measured value to monitor operation of the compressor system.

6. The compressor system of claim 1, further comprising a man/machine interface configured to be operated by a vehicle driver and which signals the special case of need to the at least one feedback-control device so that the feedback-control device increases the conveying capacity of the at least one compressor beyond the specified maximum operating power.

7. The compressor system of claim 1, wherein the feedback-control device is configured to suppress the energizing of the compressor system in a further special case of need, taking specified operating parameters into consideration.

8. A method for controlling a compressor system for a rail vehicle, wherein the method comprises:

generating, by at least one compressor, compressed air for at least one compressed-air vessel; and at least one feedback-control device that increases conveying capacity of the at least one compressor, at least indirectly, beyond a specified maximum operating power in a special case of need, wherein, in the special case of need, the at least one compressor is operated at a speed that is greater than a speed that results in the specified maximum operating power of the compressor during a braking operation until a compressed-air level in the at least one compressed-air vessel is stabilized, and wherein, subsequent to the compressed-air level stabilization the air compressor is configured to resume the specified maximum operating power during the braking operation.

9. The method of claim 8, wherein, in the special case of need of a borderline high consumption of compressed air, the at least one compressor is operated at a speed that is greater than the speed that results in the specified maximum operating power of the compressor.

10. The method of claim 8, wherein the special case of need is activated by a vehicle driver and/or by a vehicle control system.

11. The compressor system of claim 1, wherein, in the special case of need of a borderline high consumption of compressed air, the at least one compressor is operated at a speed that is greater than a speed that results in a specified maximum operating power of the compressor.

12. The compressor system of claim 1, wherein the special case of need is activated by the vehicle driver and/or by the vehicle control system.

13. The method of claim 8, wherein at least one pressure sensor arranged in a line carrying compressed air and arranged downstream of the at least one compressor, for determining the air pressure and/or the air-pressure gradient.

14. The method of claim 8, wherein the at least one feedback-control device increases the conveying capacity of the at least one compressor beyond the specified maximum operating power in the special case of need of a borderline high consumption of compressed air.

15. The method of claim 8, wherein the at least one feedback-control device adjusts the conveying capacity of the at least one compressor via the speed of the at least one compressor.

16. The method of claim 8, wherein at least one sensor measures a measured value to monitor operation of the compressor system.

17. The method of claim 8, wherein a man/machine interface is configured to be operated by the vehicle driver and signals the special case of need to the at least one feedback-control device so that the feedback-control device increases the conveying capacity of the at least one compressor beyond the specified maximum operating power.

18. The method of claim 8, wherein the feedback-control device suppresses the energizing of the compressor system in a further special case of need, taking specified operating parameters into consideration.

* * * * *